US010738494B1

(12) United States Patent
Krombein

(10) Patent No.: US 10,738,494 B1
(45) Date of Patent: Aug. 11, 2020

(54) CHANNEL DRAIN ASSEMBLY

(71) Applicant: Todd Krombein, Phoenix, AZ (US)

(72) Inventor: Todd Krombein, Phoenix, AZ (US)

( * ) Notice: Subject to any disclaimer, the term of this patent is extended or adjusted under 35 U.S.C. 154(b) by 0 days.

(21) Appl. No.: 16/297,434

(22) Filed: Mar. 8, 2019

Related U.S. Application Data

(60) Provisional application No. 62/640,519, filed on Mar. 8, 2018.

(51) Int. Cl.
*E04H 4/12* (2006.01)

(52) U.S. Cl.
CPC ..... *E04H 4/1218* (2013.01)

(58) Field of Classification Search
CPC ... E04H 4/1218; E04H 4/1236; E04H 4/1209; E04H 4/12
USPC ..... 4/510
See application file for complete search history.

(56) References Cited

U.S. PATENT DOCUMENTS

| | | | | |
|---|---|---|---|---|
| 5,341,523 | A | 8/1994 | Barnes | |
| 5,458,769 | A | 10/1995 | Johannessen | |
| 5,729,937 | A | 3/1998 | Mantelli | |
| 6,397,408 | B1 | 6/2002 | Veloskey et al. | |
| 6,595,243 | B2 | 7/2003 | Tarr | |
| 6,810,537 | B1 | 11/2004 | Barnes et al. | |
| 7,089,607 | B2 | 8/2006 | Barnes et al. | |
| 7,739,757 | B2 | 6/2010 | Witt | |
| 7,774,870 | B2 * | 8/2010 | Griffin | E04H 4/1236 4/507 |
| 7,862,729 | B2 | 1/2011 | Stetson | |
| 8,474,068 | B2 * | 7/2013 | Kik, Sr. | E03F 3/046 4/613 |
| 9,200,464 | B1 * | 12/2015 | Blake | E04H 4/1218 |
| 9,540,837 | B2 * | 1/2017 | Mjelde | E04H 4/1236 |
| 10,344,491 | B2 * | 7/2019 | Mjelde | E04H 4/1236 |
| 2008/0282466 | A1 | 11/2008 | Swan | |
| 2012/0018362 | A1 | 1/2012 | Swanston | |
| 2012/0036629 | A1 | 2/2012 | Cook | |
| 2012/0036630 | A1 | 2/2012 | Cook | |

(Continued)

FOREIGN PATENT DOCUMENTS

| | | |
|---|---|---|
| AU | 199944555 B2 | 3/2000 |
| KR | 20-2008-0006173 | 12/2008 |
| PH | 2/2004/000116 | 11/2006 |

OTHER PUBLICATIONS

MDX Debris Removal System Manual, Feb. 2007.
Pool Supply Unlimited website printout AquaStar 8" Suction Outlet Cover with Sump Bucket.

*Primary Examiner* — Huyen D Le
(74) *Attorney, Agent, or Firm* — Knobbe Martens Olson & Bear, LLP

(57) ABSTRACT

A drain assembly for an artificial body of water is provided. The drain assembly includes a one piece structure that seals onto a sump and allows the drain openings to be selected from one or more circular, slotted, or other shaped drain openings The drain assembly can include a baffle that sits within an elongate internal space enclosed by a sump and the single drain cover. The drain cover can include an access opening disposed between a first inlet opening and a second inlet opening of the drain cover. The access cover can have a greater cross-sectional area than that of the first inlet opening and the second inlet opening. The access cover and the drain cover can each be adapted to receive plaster on a top surface to allow the access cover to blend in with the drain cover.

16 Claims, 5 Drawing Sheets

(56) References Cited

U.S. PATENT DOCUMENTS

| | | | | |
|---|---|---|---|---|
| 2012/0036631 | A1 | 2/2012 | Cook | |
| 2012/0036697 | A1 | 2/2012 | Cook | |
| 2013/0061387 | A1 | 3/2013 | Stetson et al. | |
| 2014/0157510 | A1* | 6/2014 | Mjelde | E04H 4/1236 4/510 |

* cited by examiner

CHANNEL DRAIN ASSEMBLY

BACKGROUND

Field

This disclosure generally relates to drains for artificial bodies of water, and in particular, channel drain assemblies for swimming pools and the like.

Description of Certain Related Art

Artificial bodies of water (e.g., swimming pools, spas) can include channel drains that provide a flow path to a pumping system that circulates the water. Channel drains typically have an elongated body with elongated openings and grating that can be installed on the pool floor. However, the linear configuration of channel drains may not be aesthetically compatible with the surrounding of certain pool floors. A need exists for channel drains that can blend in with different surroundings of water features.

SUMMARY

The systems, methods and devices described herein have innovative aspects, no single one of which is indispensable or solely responsible for their desirable attributes. Without limiting the scope of the present disclosure, some of the advantageous features will now be summarized.

Embodiments of the present disclosure relate to apparatuses and methods for safe, aesthetically-appealing drains for artificial bodies of water (e.g., swimming pools, spas). Some of the apparatuses described herein comprise an elongate channel drain assembly that blends in with the surrounding surface into which the drain is mounted. In some aspects, the drain assembly provides flexibility in the configuration of the drain openings. In some embodiments, the drain assembly provides a one piece structure that seals onto a sump and allows the drain openings to be selected from one or more circular, slotted, or other shaped drain openings. In some embodiments, the drain assembly provides a single sump and a single drain cover configured to resemble multiple drain covers when installed in a pool. In some embodiments, the drain assembly includes an interchangeable drain cover that can allow the appearance of the drain assembly to be changed (e.g., tailored to fit the appearance of the surrounding water feature). In some embodiments, the single drain cover that is mounted onto the sump can be selected from a group of single drain covers that includes a first single drain cover having a first arrangement of inlet openings and a second single drain cover having a second arrangement of inlet openings. A user can install the first or the second single drain cover onto the sump. The first single drain cover can be attached to the sump and installed into the water feature to give the appearance that the water feature has a first arrangement of multiple drains (e.g., two spaced apart circular drains). The second single drain cover can be attached to the sump and installed into the water feature to give the appearance that the water feature has a second arrangement of multiple drains (e.g., two spaced apart slotted drains). In some aspects, the drain assembly includes a single sump and a single drain cover that are attached together to enclose a single open chamber that extends under the entire length of the drain cover. The single open chamber can receive directly water inflow from each of the two or more inlet openings that are disposed on the single drain cover.

In some aspects, the single drain cover can include an access opening that is sufficiently large to allow service access to the enclosed internal space of the drain assembly. The cross-sectional area of the access opening can be larger than the cross-sectional area of the inlet openings of the single drain cover. The drain assembly can include an access opening cover that covers the access opening such that the appearance of the access opening blends in with the surrounding floor of the water feature. In some embodiments, the access opening cover includes a flow inlet opening that provides a flow path for water to pass through the access opening cover to reach the common open chamber that extends under the single drain cover and is enclosed by the singled drain cover and the single sump. In some aspects, the drain assembly includes features (e.g., spaced apart inlet openings) that reduce dangerous suction forces that can entrap or injure a swimmer.

Any of the features, components, or details of any of the arrangements or embodiments disclosed in this application, including without limitation any of the drain embodiments and any of the methods of draining liquid from a body of water disclosed below, are interchangeably combinable with any other features, components, or details of any of the arrangements or embodiments disclosed herein to form new arrangements and embodiments.

BRIEF DESCRIPTION OF THE DRAWINGS

Throughout the drawings, reference numbers can be reused to indicate general correspondence between reference elements. The drawings are provided to illustrate example embodiments described herein and are not intended to limit the scope of the disclosure.

DETAILED DESCRIPTION

Figure 1:
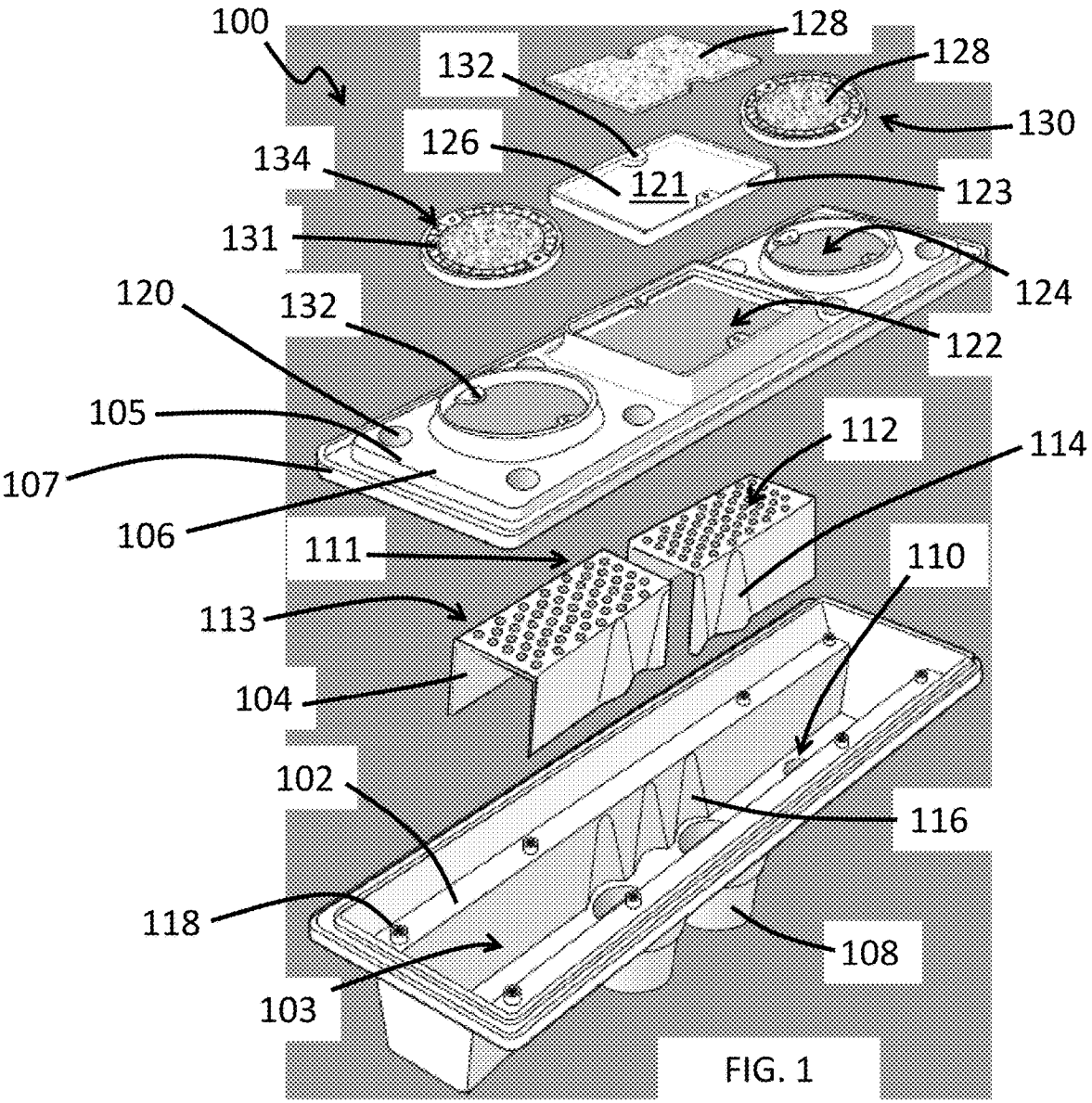
FIG. 1 is an exploded view of an embodiment of a drain assembly according to some aspects of the present disclosure.

Embodiments of systems, components and methods of assembly and manufacture will now be described with reference to the accompanying figures, wherein like numerals refer to like or similar elements throughout. Although several embodiments, examples and illustrations are disclosed below, it will be understood by those of ordinary skill in the art that the inventions described herein extends beyond the specifically disclosed embodiments, examples and illustrations, and can include other uses of the inventions and obvious modifications and equivalents thereof. The terminology used in the description presented herein is not intended to be interpreted in any limited or restrictive manner simply because it is being used in conjunction with a detailed description of certain specific embodiments of the inventions. In addition, embodiments of the inventions can comprise several novel features and no single feature is solely responsible for its desirable attributes or is essential to practicing the inventions herein described.

Certain terminology may be used in the following description for the purpose of reference only, and thus are not intended to be limiting. For example, terms such as "above" and "below" refer to directions in the drawings to which reference is made. Terms such as "front," "back," "left," "right," "rear," and "side" describe the orientation and/or location of portions of the components or elements within a consistent but arbitrary frame of reference which is made clear by reference to the text and the associated drawings describing the components or elements under discussion. Moreover, terms such as "first," "second," "third," and so on may be used to describe separate components. Such terminology may include the words specifically mentioned above, derivatives thereof, and words of similar import.

Artificial bodies of water, such as pools, spas, fountains, ornamental ponds, utility ponds and the like, typically have filter systems that allow the water in the body of water to be filtered and cleaned. Channel drains allow inlet suction forces of the drain to be distributed over an elongate area thereby can reduce the likelihood of a swimmer being entrapped by the drain. In some aspects, channel drains can provide an elongate slotted opening that can be more effective at drawing debris (e.g., leaves) into the drain compared to a circular opening.

The elongate appearance of channel drains can be unsightly and can disrupt the aesthetic appeal of the artificial body of water. The drain assembly of the present disclosure provides a channel drain assembly that allows the visual appearance of the drain inlet to be tailored to the features of the water feature into which the drain assembly is installed. The present drain assembly can include an access opening that allows service access to the enclosed space of the drain assembly. In some embodiments, the access opening has a cross-sectional area sufficiently large to allow the drain to be serviced (e.g., clear debris entrapped within the elongate open chamber enclosed by the single drain cover and the single sump). In some arrangements, the cross-sectional area of the access opening is larger than the cross-sectional area of the flow inlet openings of the single drain cover. In some embodiments, the drain assembly includes an access opening cover adapted to receive plaster such that the access opening cover conceals the presence of the access opening. In some embodiments, the access opening cover includes a flow inlet that allows water to flow through the access opening cover to reach the single open chamber that is enclosed by the single drain cover and the single sump.

In some aspects, the present disclosure is directed to a drain assembly that aesthetically blends in with a surrounding surface. In some aspects, the drain assembly of the present disclosure allows for the redesign of the appearance of the drain openings into any desired configuration. For example, the drain assembly can allow the drain openings to be configured as an arrangement of spaced apart openings that can have a circular shape, a slotted shape, or other shapes that are desired. As discussed, drains can also be dangerous and can create suction forces that can entrap a swimmer's hair, clothing, or skin, causing injury or drowning. Aspects of the present disclosure are directed to a drain assembly that avoids the creation of dangerous suction forces.

FIG. 1 shows an illustrative, non-limiting embodiment of a drain assembly 100 for an artificial body of water. The drain assembly 100 can include a sump 102, a baffle 104, and a drain cover 106. The drain cover 106 can be a single piece that seals onto the sump 102 and has one or more openings that communicate with the elongate internal space 103 of the sump 102. As discussed below, the single drain cover 106 can provide flexibility in the design of the drain openings that provide water flow paths to the sump 102. The drain assembly 100 can be configured so that the sump 102 can receive a plurality of interchangeable single drain covers 106, wherein each of the plurality of single drain covers 102 has a different arrangement of flow inlet openings. As discussed, a user can select which single drain cover 106 of the plurality to attach to the sump 102 based on the desired appearance of the flow inlet openings. In the illustrated embodiment, the drain cover 106 is designed to give the appearance of two small, spaced apart circular drains.

As shown in FIG. 1, the sump 102 can include two outflow ports 108. In some embodiments, the sump 102 can include one, three, or more than three outflow ports 108. The outflow port 108 can be fluidically connected to the inlet of a pump (not shown). In some embodiments, the sump 102 can include a plurality of outflow ports 108 that are each connected to a different pump. For example, the sump 102 can include two outflow ports 108, with one of the outflow ports 108 being fluidically connected to the inlet of a first pump and the other outflow port 108 being fluidically connected to the inlet of a second pump. As shown in FIG. 1, the sump 102 can include a hydrostatic relief valve 110.

With continued reference to FIG. 1, the baffle 104 can be disposed between the drain cover 106 and the sump 102. The baffle 104 can include a plurality of holes 112. The baffle 104 can be arranged as a diffuser structure that prevents hair or other filamentous structures from entering the outflow port 108, thereby lessening the chance of hair or other filamentous structures becoming entrapped by the suction force at the outflow port 108. As shown in FIG. 1, the baffle 104 can include an index feature 114 that is shaped to mate with a corresponding receiving feature 116 on the sump 102. The baffle 104 can be arranged such that the plurality of holes 112 is aligned over top of the outflow port 108 when the index feature 114 of the baffle 104 is seated within the corresponding receiving feature 116 on the sump 102. As shown in FIG. 1, the baffle 104 can be adapted such that at least a medial portion 111 of the plurality of holes 112 is disposed between the access opening 122 and the outflow port 108 when index feature 114 of the baffle 104 is seated in the corresponding receiving feature 116 of the sump 102. A lateral portion 113 of the plurality of holes 112 can be disposed between the inlet opening 124 and sump 102 when the index feature 114 of the baffle 104 is seated in the corresponding receiving feature 116 of the sump 102.

The sump 102 can include a plurality of anchoring features 118 that allow the drain cover 106 to be attached to the sump 102. The drain cover 106 can form a seal with the sump 102, blocking water flow through the interface between the drain cover 106 and the sump 102. In the illustrated embodiment, the sump 102 includes anchoring features 118 in the form of threaded holes that align with corresponding through holes 120 on the drain cover 106. In the illustrated embodiment, the drain cover 106 can be attached to the sump 102 by passing a screw (not shown) through the through hole 120 of the drain cover 106 and securing the screw into the threaded hole of the anchoring feature 118 of the sump 102. In some embodiments, the drain cover 106 can be attached to the sump 102 using an adhesive (e.g., glue) or by welding (e.g., sonic welding).

As shown in FIG. 1, the drain cover 106 can have an elongate pan-like shape with one or more central openings passing through drain cover 106. The drain cover 106 can have a central surface 105 and a lip 107 extending upwardly from the perimeter of central surface 105 to define a plaster seat sized to receive sufficient plaster 128 (FIG. 4B) so that the upper surface of the drain cover 106 matches or blends in with the surrounding surface into which the drain assembly 100 is installed.

With continued reference to FIG. 1, the drain cover 106 can have an access opening 122 that is flanked by a pair of inlet openings 124. Water can flow through the inlet opening 124 to reach the outflow port 108 of the sump 102. In some embodiments, the inlet opening 124 is sized to receive an inlet opening cover 130. The inlet opening cover 130 can be adapted to receive plaster 128 in a portion of the inlet opening cover 130, while other portions of the inlet opening cover 130 remain free of plaster such that water can flow through the plaster-free portions of the inlet opening cover 130 to reach the elongate internal space 103 enclosed between the sump 102 and the drain cover 106. The inlet openings 124 can be configured into achieve the appearance of any desired arrangement of drain openings. In the illustrated embodiment, the inlet openings 124 are arranged to give the appearance that the water feature has a pair of spaced apart, small, circular drains. The inlet openings 124 can be otherwise arranged to give the water feature a different aesthetic appearance (e.g., two distinct, spaced-apart, slotted drains).

Water can be blocked from flowing through the access opening 122 by an access opening cover126 that seats over the access opening 122. In some embodiments, the access opening 122 can be sized to receive the access opening cover 126. The access opening cover 126 can be adapted to receive plaster 128 in a portion of the access opening cover 126, while other portions of the access opening cover 126 remain free of plaster such that water can flow through the plaster-free portions of the access opening cover 126 to reach the enclosed space between the sump 102 and the drain cover 106. As shown in FIG. 1, the access opening cover 126 can have a base surface 121 and a sidewall 123 extending upwardly from the perimeter of the base surface 121 to define a plaster receiving platform that is adapted to receive plaster 128. The plaster 128 applied to the access opening cover 126 can be substantially co-planar with, and can match the appearance of, the plaster 128 that is applied to the central surface 105 of the drain cover 106 and/or the plaster 128 that is applied to the inlet opening cover 130. In some embodiments, the plaster 128 can be an aggregate or can be mixed with loosely compacted mass of fragments or particles such as pebbles. The plaster 128 applied to the access opening cover 126 can be flush with the plaster applied to the drain cover 106. In other words, the upper surface of the plaster applied to the access opening cover 126 can be level with the upper surface of the plaster applied to the drain cover 106.

As discussed herein, the inlet opening 124 can be adapted to receive an inlet cover 130. The inlet cover 130 can include a central portion that is adapted to receive plaster 128 and a peripheral portion that is adapted to remain plaster free, as described herein. The plaster 128 applied to the inlet cover 130 can be substantially co-planar with, and can match the appearance of, the plaster 128 that is applied to the central surface 105 of the drain cover 106 and/or the plaster 128 that is applied to the access opening cover 126. The inlet cover 130 can have an annular opening 134 that surrounds the plaster 128, as shown in FIG. 1. Water can flow through the annular opening 134 to pass through the inlet opening 124 and reach the outflow port 108 of the sump 102. In the illustrated embodiment, the annular opening 134 is covered by a grate 131. In some embodiments, the annular opening 134 can be uncovered or an open flow system (i.e., no grate 131). In some variants, the inlet cover 130 can include one or more features of a high flow drain cover assembly. Further details of high flow drain cover assemblies are found in U.S. Pat. No. 9,822,539, filed on Jan. 11, 2016, and incorporated by reference herein in its entirety.

As shown in FIG. 1, the drain assembly 100 of the present disclosure can direct water flow to the sump 102 through two spaced apart inlet covers 130. In this way, the suction forces of the drain assembly 100 can be reduced in magnitude and can be distributed apart from one another, thereby reducing the likelihood of a swimmer being entrapped by the suction force of the drain assembly 100. By including multiple, spaced-apart inlet openings 124, the drain assembly 100 can achieve high flow rates with inlet openings 124 that are reduced in cross-sectional area (i.e., smaller diameter) while avoiding creating dangerous, high-magnitude suction forces that can entrap swimmers. By reducing the size of the inlet opening 124, the cross-sectional area of the top surface of the inlet cover 130 can be reduced, thereby enhancing the ability of the inlet cover 130 to blend in with the surrounding surfaces and increasing the aesthetic appeal of the drain assembly 100.

The access opening 122 can provide a pathway for access to the elongate internal space 103 of the drain assembly 100. In some embodiments, the access opening 122 can be removed from the drain cover 106 to provide access to the internal components of the drain assembly 100 (e.g., the baffles 104) and to the drain pipe (not shown) to which the outflow port 108 is connected. The cross-sectional area of the access opening 122 can be larger than the cross-sectional area of the inlet opening 124. In some embodiments, the cross-sectional area of the access opening 122 is sized to allow the baffle 104 to be removed from the elongate internal space 103 of the sump 102 through the access opening 122. As shown in FIG. 1, the access opening cover 126 can include one or more fastening sites 132 adapted to reversibly secure the access opening cover 126 to the drain cover 106. The fastening sites can remain unobscured by the plaster 128 applied to the access opening cover 126, thereby allowing for the access opening cover 126 to be removably secured to the drain cover 106. The access opening cover 126 can be removed from the drain cover 106 to gain access to the access opening 122. As shown in FIG. 1, the inlet opening 124 and the inlet opening cover 130 can include similar fastening sites 132 that allow the inlet opening cover 130 to be reversibly attached to the single drain cover 106.

The drain assembly 100 can be installed by securing the outflow port 108 to a drain (not shown). The sump 102 can be embedded in concrete or mortar surrounding the drain. The baffles 104 can be placed into the sump 102 and positioned over the outflow port 108. The drain cover 106 can be installed onto the sump 102 by a fastener that passes through the through hole 120 of the drain cover 106 and is secured to the corresponding anchoring feature 118 of the sump 102. Plaster can be applied to the central surface 105 of the drain cover 106 to bury the drain cover 106. The plaster applied to the central surface 105 can be flush with the plaster of a surrounding surface. The access opening cover 126 and the inlet covers 130 can be attached to the drain cover 106. Plaster can be applied to the top surfaces of the access opening cover 126 and the inlet covers 130. The plaster applied to the top surfaces of the access opening cover 126 and the inlet covers 130 can be substantially co-planar with, and can match the appearance of, the plaster applied to the central surface 105 of the drain cover 106. The plaster applied to the top surfaces of the access opening cover 126 and the inlet covers 130 can be flush with the plaster applied to the central surface 105 of the drain cover 106. If access to the drain is required, the access opening cover 126 can be removed from the drain cover 106 and replaced onto the drain cover 106 after the task requiring access to the drain is completed.

Figure 2:
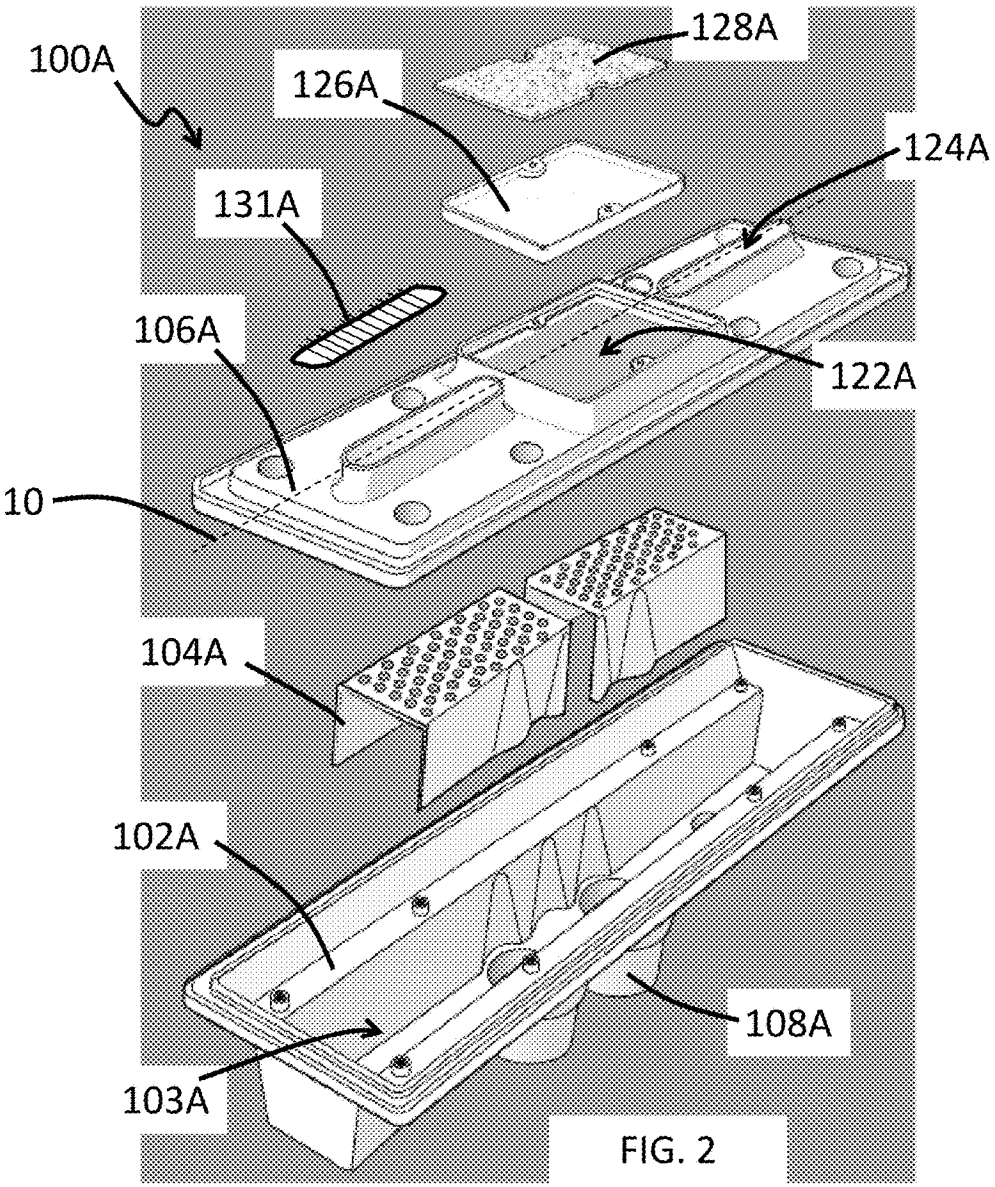
FIG. 2 is an exploded view of another embodiment of a drain assembly according to some aspects of the present disclosure.

FIG. 2 depicts another embodiment of a drain assembly 100A of the present disclosure. The single drain cover 106A is arranged to give the appearance that the water feature has two, spaced apart, slotted drains that are longitudinally aligned with one another. The drain assembly 100A is similar to the drain assembly 100 except as described differently below. The features of drain assembly 100A can be combined or included with the drain assembly 100 or any other embodiment discussed herein. As shown in FIG. 2, the drain assembly 100A can include a single drain cover 106A having an access opening 122A disposed between a pair of inlet openings 124A. In the illustrated embodiment, the inlet openings 124A are slot-like openings that are aligned with a longitudinal axis 10 of the drain cover 106A. The inlet openings 124A can be uncovered (i.e., no grate 131A). In some embodiments, the inlet openings 124A are covered by a grate 131A. As discussed above, the drain cover 106A can have multiple, spaced apart inlet openings 124A, allowing the area of the inlet openings 124A to be reduced to enhance the ability of the drain assembly 100A to blend in with surrounding surfaces without creating dangerous suction forces.

Figure 3:
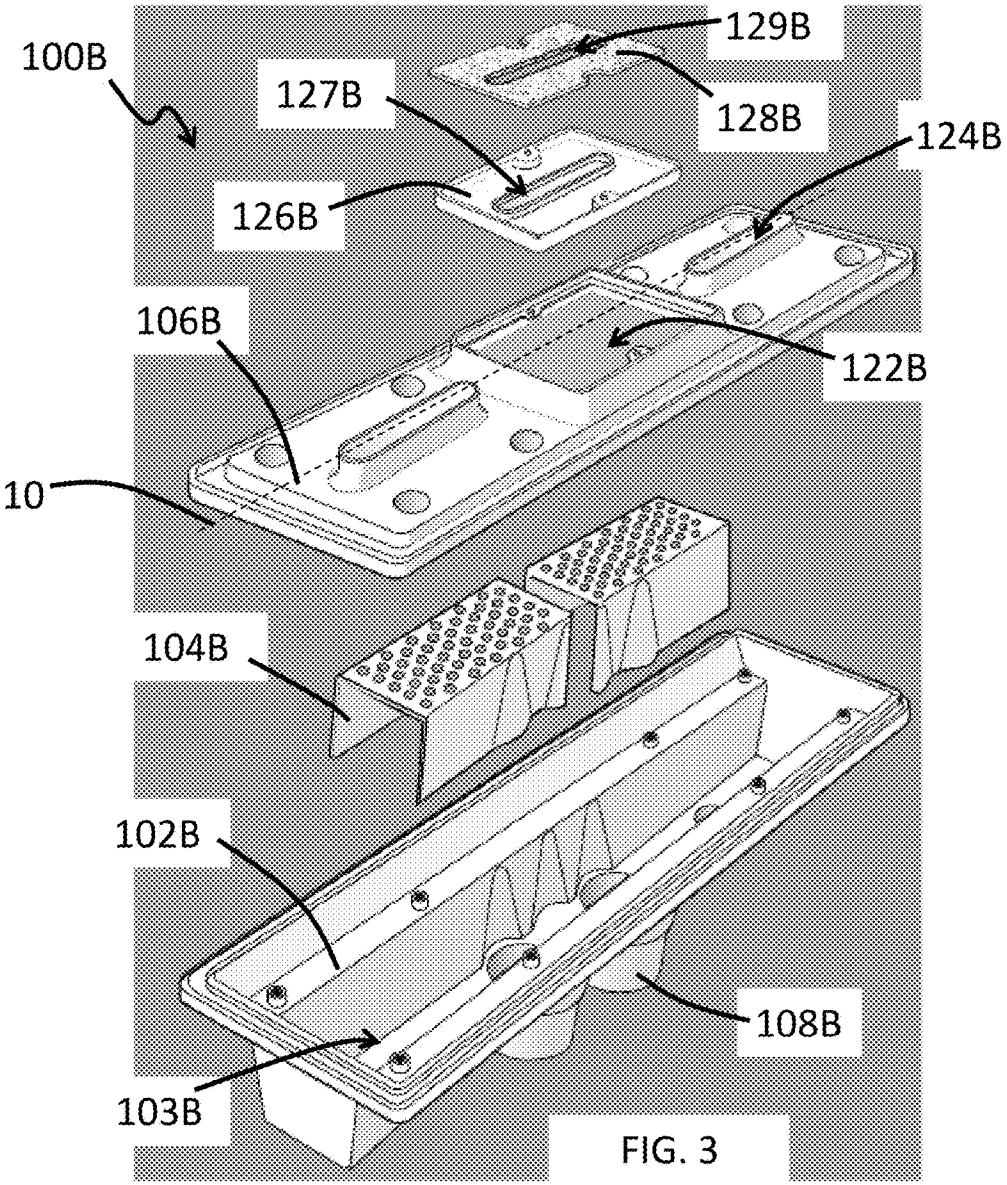
FIG. 3 is an exploded view of another embodiment of a drain assembly according to some aspects of the present disclosure.

FIG. 3 depicts another embodiment of a drain assembly 100B of the present disclosure. The drain cover 106B is arranged to give the appearance that the water feature has three, spaced apart, slotted drains that are longitudinally aligned with one another. The drain assembly 100B is similar to the drain assembly 100A except as described differently below. The features of drain assembly 100B can be combined or included with the drain assembly 100A or any other embodiment discussed herein. As shown in FIG. 3, the access opening cover 126B can include a flow path opening 127B. The flow path opening 127B can provide a flow path for water to pass through the access opening cover 126B to reach the internal space 103B of the drain assembly 100B. A raised sidewall can surround the perimeter of the flow path opening 127B such that a void 129B can be formed in the plaster 128B that is applied to the access opening cover 126B. Water can flow through the void 129B and the flow path opening 127B to pass through the access opening 122B and reach the outflow port 108B of the sump 102B. In the illustrated embodiment, the flow path opening 127B and the inlet openings 124A are uncovered and substantially aligned with a longitudinal axis 10 of the drain cover 106B. In some variants, the flow path opening 127B or the inlet openings 124A can include a grate 131A (FIG. 2). As described previously, the access opening cover 126B can include attachment features that are unobscured by the plaster applied to the access opening cover 126B, allowing the access opening cover 126B to be reversibly removed from the drain cover 106B to gain access to the access opening 122B. As discussed above, plaster can be applied to the drain cover 106B such that the plaster applied to the drain cover 106B is substantially co-planar with and substantially matches the appearance of the plaster 128B that is applied to the access opening cover 126B.

Figure 4A:
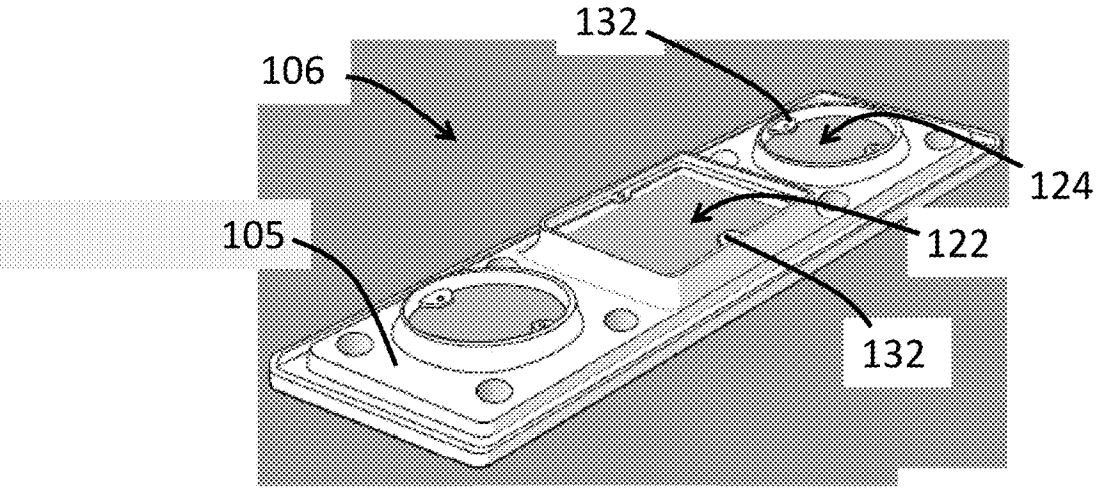
FIG. 4A illustrates an embodiment of a drain cover of a drain assembly according to some aspects of the present disclosure.
Figure 4B:
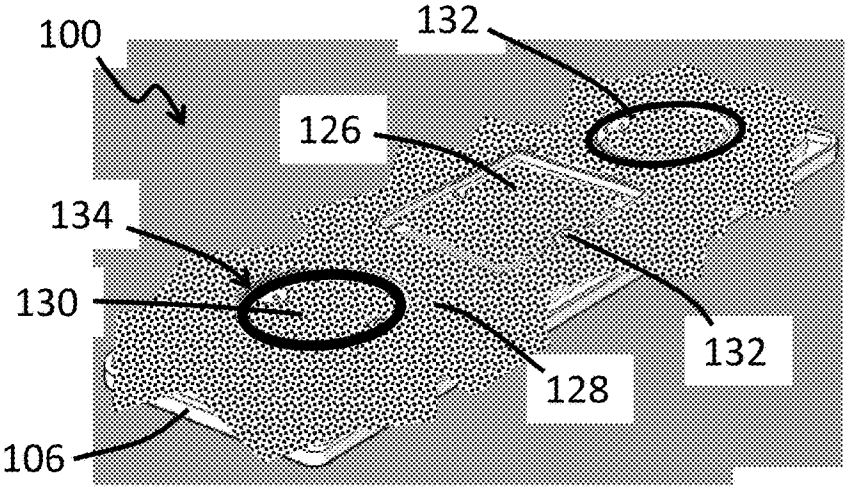
FIG. 4B illustrates the drain cover of FIG. 4A installed in a floor of a water feature.

FIG. 4A shows the drain cover 106 of the drain assembly 100 shown in FIG. 1. FIG. 4B illustrates how plaster 128 can be applied to the drain cover 106 to blend the drain cover 106 in with the surrounding floor of the water feature into which the drain assembly 100 is installed. For the sake of clarity, only the drain cover 106 is shown in FIG. 4B. However, in use, the drain cover 106 would be attached to the sump 102 (FIG. 1), and the sump 102 would be embedded into the floor of the water feature such that the single drain cover 106 is disposed between the plaster 128 and the single sump 102, as described herein. As shown in FIG. 4B, after the drain cover assembly 100 has been installed in the floor of a surrounding water feature, plaster 128 can be applied to the central surface 105 of the single drain cover 106. FIG. 4B also shows the drain cover 106 can receive an access opening cover 126 and an inlet opening cover 130 that are also covered with plaster 128. As discussed, the fastening sites 132 of the access opening cover 126 and the inlet opening cover 130 can be left plaster free so that the covers 126, 130 can be reversibly attached to the single drain cover 106. As shown in FIG. 4B, the drain assembly 100 can give the appearance that the drain assembly 100 is two distinct, spaced-apart annular openings 134.

Figure 5A:
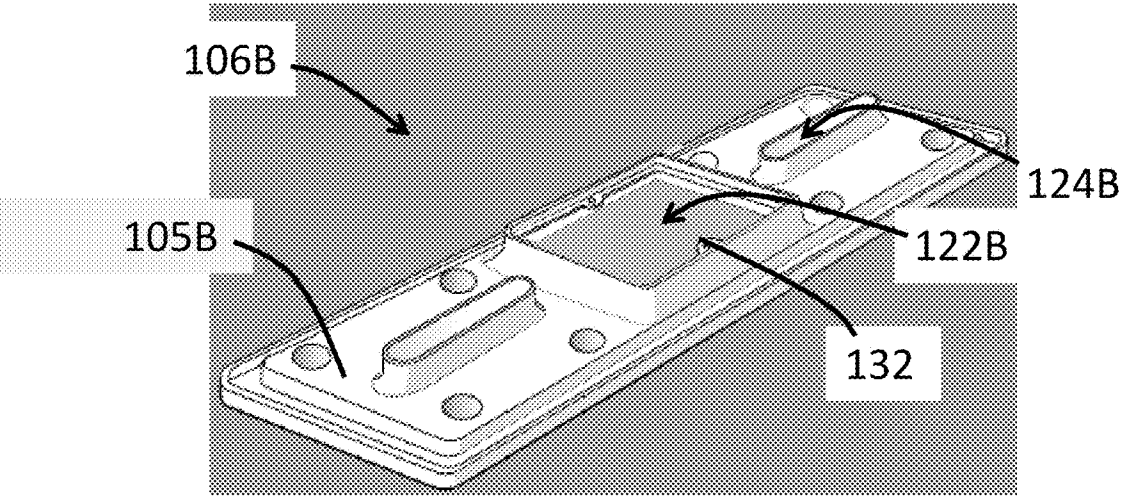
FIG. 5A illustrates another embodiment of a drain cover of a drain assembly according to some aspects of the present disclosure.
Figure 5B:
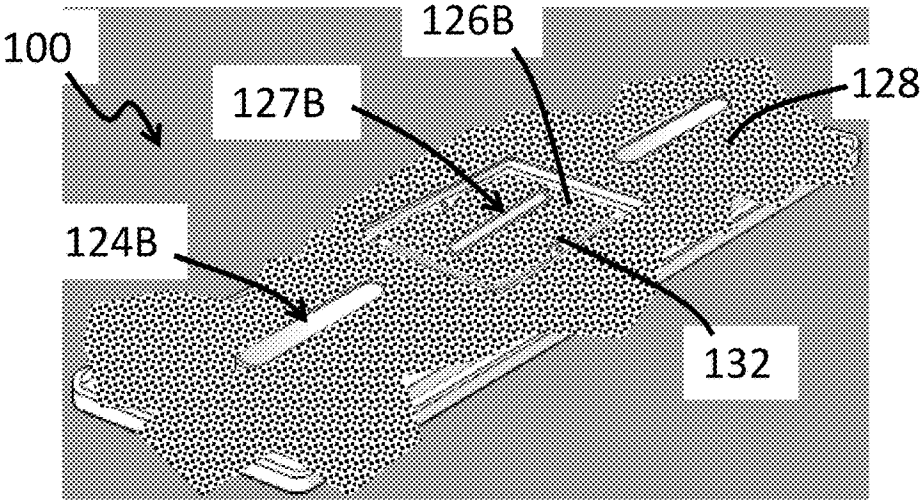
FIG. 5B illustrates the drain cover of FIG. 5A installed in a floor of a water feature.

FIGS. 5A and 5B illustrate the look of the drain assembly 100B (FIG. 3) after the drain assembly 100B has been installed in the floor of a water feature. As shown in FIG. 5B, the access opening cover 126B can include a flow path opening 127B that allows water to flow through the access opening cover 126B to reach the common open chamber enclosed by the single drain cover 106B and the sump 102B (FIG. 3), as described herein.

Certain Terminology

It should be emphasized that many variations and modifications may be made to the herein-described embodiments, the elements of which are to be understood as being among other acceptable examples. All such modifications and variations are intended to be included herein within the scope of this disclosure and protected by the following claims. Moreover, as should be apparent, the features and attributes of the specific embodiments disclosed herein may be combined in different ways to form additional embodiments, all of which fall within the scope of the present disclosure.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

Moreover, the following terminology may have been used herein. The singular forms "a," "an," and "the" include plural referents unless the context clearly dictates otherwise. The term "about" or "approximately" means that quantities, dimensions, sizes, formulations, parameters, shapes and other characteristics need not be exact, but may be approximated and/or larger or smaller, as desired, reflecting acceptable tolerances, conversion factors, rounding off, measurement error and the like and other factors known to those of skill in the art. The term "substantially" means that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide. Furthermore, where the terms "and" and "or" are used in conjunction with a list of items, they are to be interpreted broadly, in that any one or more of the listed items may be used alone or in combination with other listed items.

What is claimed is:

1. A drain assembly comprising:

a sump comprising an outflow port;

a single drain cover adapted to attach to the sump such that the single drain cover and the sump enclose an elongate internal space therebetween, the single drain cover comprising a first group of inlet openings, a second group of inlet openings, and an access opening disposed between the first group of inlet openings and the second group of inlet openings, wherein the first group of inlet openings and the second group of inlet openings are separated from each other and arranged on the single drain cover in a manner such that the single drain cover resembles two or more separate drain covers when installed in a pool;

a baffle comprising an index feature and a plurality of holes, the baffle sized to fit within the elongate internal space, the index feature adapted to sit within a corresponding receiving feature of the sump, a medial portion of the plurality of holes disposed between the access opening and the outflow port when the index feature sits within the corresponding receiving feature; and an access opening cover sized to seat within the access opening, the access opening cover comprising a plaster-receiving portion comprising a base surface and a sidewall extending from a periphery of the base surface.

2. The drain assembly of claim 1, wherein the first inlet opening has a shape that is similar to the shape of the second inlet opening.

3. The drain assembly of claim 2, wherein the shape is a circle.

4. The drain assembly of claim 2, wherein the shape is a slot.

5. The drain assembly of claim 1, wherein the access opening has a cross-sectional area that is greater than a cross-sectional area of the first inlet opening.

6. The drain assembly of claim 1, wherein the access opening cover comprises a flow path opening.

7. The drain assembly of claim 1, further comprising:

a first inlet opening cover sized to seat within the first inlet opening; and a second inlet opening cover sized to seat within the second inlet opening.

8. The drain assembly of claim 7, wherein the first inlet opening cover comprises a plaster-receiving portion adapted to receive plaster.

9. The drain assembly of claim 8, wherein the first inlet opening comprises an annular opening that circumferentially surrounds the plaster-receiving portion.

10. The drain assembly of claim 9, further comprising a grate adapted to sit within the annular opening.

11. A method of servicing a drain assembly, the method comprising:

unfastening an access opening cover from a drain cover of the drain assembly, wherein the access opening cover has plaster disposed on a plaster-receiving portion of the access opening cover and the drain cover has plaster disposed on a plaster-receiving portion of the drain cover such that the access opening cover blends in with the drain cover, the access opening cover disposed between a first inlet opening and a second inlet opening of the drain cover;

removing the access opening cover from an access opening of the drain cover, the access opening having a cross-sectional area greater than a cross-sectional area of each of the first inlet opening and the second inlet opening;

accessing an internal space enclosed by the drain cover and a sump of the drain assembly to thereby service the drain assembly;

replacing the access opening cover into the access opening; and re-fastening the access opening cover to the drain cover.

12. The method of claim 11, further comprising removing a baffle from the internal space.

13. The method of claim 12, wherein removing the baffle comprises passing the baffle through the access opening.

14. A method of assembling a drain assembly, the method comprising:

placing a baffle within an elongate internal space of a sump such that an index feature of the baffle sits within a corresponding receiving feature of the sump;

attaching a drain cover to the sump such that the elongate internal space is enclosed by the drain cover and the sump, wherein the drain cover comprises an access opening, a first inlet opening, and a second inlet opening, the access opening disposed between the first inlet opening and the second inlet opening;

applying plaster to the drain cover;

applying plaster to a plaster-receiving portion of an access opening cover sized to sit within the access opening; and fastening the access opening cover to the drain cover.

15. The method of claim 14, wherein placing the baffle is performed after attaching the drain cover to the sump.

16. The method of claim 14, further comprising:

placing a first inlet opening cover within the first inlet opening; and applying plaster to the first inlet opening cover.

* * * * *